US008628416B2

(12) United States Patent
Scott et al.

(10) Patent No.: US 8,628,416 B2
(45) Date of Patent: Jan. 14, 2014

(54) DEVICE EMBEDDED IN GAMING MACHINE HANDLE

(75) Inventors: William Scott, Palo Alto, CA (US); Nicholas Koenig, Corralitos, CA (US)

(73) Assignee: IGT, Reno, NV (US)

( * ) Notice: Subject to any disclaimer, the term of this patent is extended or adjusted under 35 U.S.C. 154(b) by 1261 days.

(21) Appl. No.: 11/692,666

(22) Filed: Mar. 28, 2007

(65) Prior Publication Data

US 2008/0242397 A1 Oct. 2, 2008

(51) Int. Cl.
*A63F 9/24* (2006.01)

(52) U.S. Cl.
USPC ..... 463/38; 463/16; 463/42; 463/46

(58) Field of Classification Search
USPC ..... 463/16–20, 38, 42, 46
See application file for complete search history.

(56) References Cited

U.S. PATENT DOCUMENTS

| | | | | |
|---|---|---|---|---|
| 4,524,636 | A | 6/1985 | Nishikawa | |
| 4,572,010 | A | 2/1986 | Heywood | |
| 4,582,324 | A * | 4/1986 | Koza et al. | 463/16 |
| 4,597,309 | A | 7/1986 | Nishikawa | |
| 4,600,197 | A | 7/1986 | Bean | |
| 4,802,380 | A | 2/1989 | Shirasawa | |
| 5,303,919 | A | 4/1994 | Takemoto et al. | |
| 5,342,049 | A * | 8/1994 | Wichinsky et al. | 273/119 R |
| 5,380,008 | A * | 1/1995 | Mathis et al. | 463/18 |
| 5,472,197 | A | 12/1995 | Gwiasda et al. | |
| 6,932,706 | B1 * | 8/2005 | Kaminkow | 463/36 |
| 2002/0004423 | A1 * | 1/2002 | Minami et al. | 463/38 |
| 2003/0069074 | A1 * | 4/2003 | Jackson | 463/43 |
| 2003/0171144 | A1 * | 9/2003 | Letovsky | 463/16 |
| 2003/0216174 | A1 * | 11/2003 | Gauselmann | 463/30 |
| 2003/0224858 | A1 * | 12/2003 | Yoseloff et al. | 463/43 |
| 2004/0009798 | A1 * | 1/2004 | Okuda et al. | 463/7 |
| 2004/0048659 | A1 * | 3/2004 | Seelig et al. | 463/25 |
| 2004/0192442 | A1 * | 9/2004 | Wells et al. | 463/36 |
| 2005/0239538 | A1 * | 10/2005 | Dixon | 463/20 |
| 2006/0007151 | A1 * | 1/2006 | Ram | 345/163 |
| 2006/0014586 | A1 * | 1/2006 | Gatto et al. | 463/46 |
| 2006/0040735 | A1 * | 2/2006 | Baerlocher | 463/26 |
| 2006/0211497 | A1 * | 9/2006 | Manz | 463/37 |

* cited by examiner

*Primary Examiner* — Steve Rowland
(74) *Attorney, Agent, or Firm* — Foley & Lardner LLP

(57) ABSTRACT

Provided in embodiments of the present invention is a gaming device with a player interaction mechanism included in a gaming machine handle. In one embodiment, a gaming device operable by a player includes a gaming cabinet housing a processor to operate gaming sessions on the gaming device and having a display to visually represent the outcome of the gaming session. The gaming device also includes a first player interaction mechanism arranged on the gaming cabinet, a gaming handle attached to the gaming cabinet, and a second player interaction mechanism located on the gaming handle.

9 Claims, 7 Drawing Sheets

DEVICE EMBEDDED IN GAMING MACHINE HANDLE

FIELD OF THE INVENTION

The present invention relates generally a device embedded in a gaming machine handle, and more particularly to a device structured to interact with a player, where the device is embedded in the handle of a gaming device.

BACKGROUND

Although gaming has existed in some form for many years, its present familiar form of slot devices, table games, sports books, etc. has mainly developed in the last few decades. In gaming devices such as slot machines, handles have traditionally been included as a means to initiate a game by spinning the reels of the slot machine. With early mechanical slot machines, the pull on the handle of the gaming machine actuated the mechanical reels and set them spinning. However, with advancement in technology, buttons or other input means on the gaming machine now largely provide the function of initiating a game. This is due in part because recent gaming machines have become processor based instead of mechanically based. Since the mechanical action of pulling the handle is no longer critical to spin the reels or otherwise initiate a gaming session, the need for these gaming handles has all but ceased. Although gaming handles still can be pulled to initiate a gaming session on current games (even those with buttons), they generally remain on spinning reel-type slot machines more as a traditional element. Further, as the buttons used to initiate a gaming session are generally faster and easier to operate than the gaming handles, many players opt to forgo the handle pull as a means of initiating game play.

One problem with the constant increase in technology and new designs in the gaming cabinets of gaming devices is that an increased emphasis is being put on display quality and graphics layouts. This, in turn, often times makes the player interface portion of the cabinet crowded or overly complicated. That is, as the display areas become larger or include features such as secondary VFD (vacuum florescent display) or LCD (liquid crystal display) screens, the actual area for the buttons used to place bets and the card reader to read a player tracking card has become scarce. Further, gaming themes and concepts that require more player interaction have become desirable creating the need for more player interaction devices on the gaming devices. However, these additional interaction devices further crowd and complicate the player interaction area of gaming devices, frustrating players and slowing down the rate of play of the gaming devices. These and other problems in conventional gaming devices are addressed by embodiments of the present invention.

SUMMARY

Embodiments of the present invention provide a device embedded in a gaming machine handle of a gaming device. In one embodiment, a gaming device operable by a player includes a gaming cabinet housing a processor to operate gaming sessions on the gaming device and having a display to visually represent the outcome of the gaming session. The gaming device also includes a first player interaction mechanism arranged on the gaming cabinet, a gaming handle attached to the gaming cabinet, and a second player interaction mechanism located on the gaming handle.

DETAILED DESCRIPTION

Figure 1A:
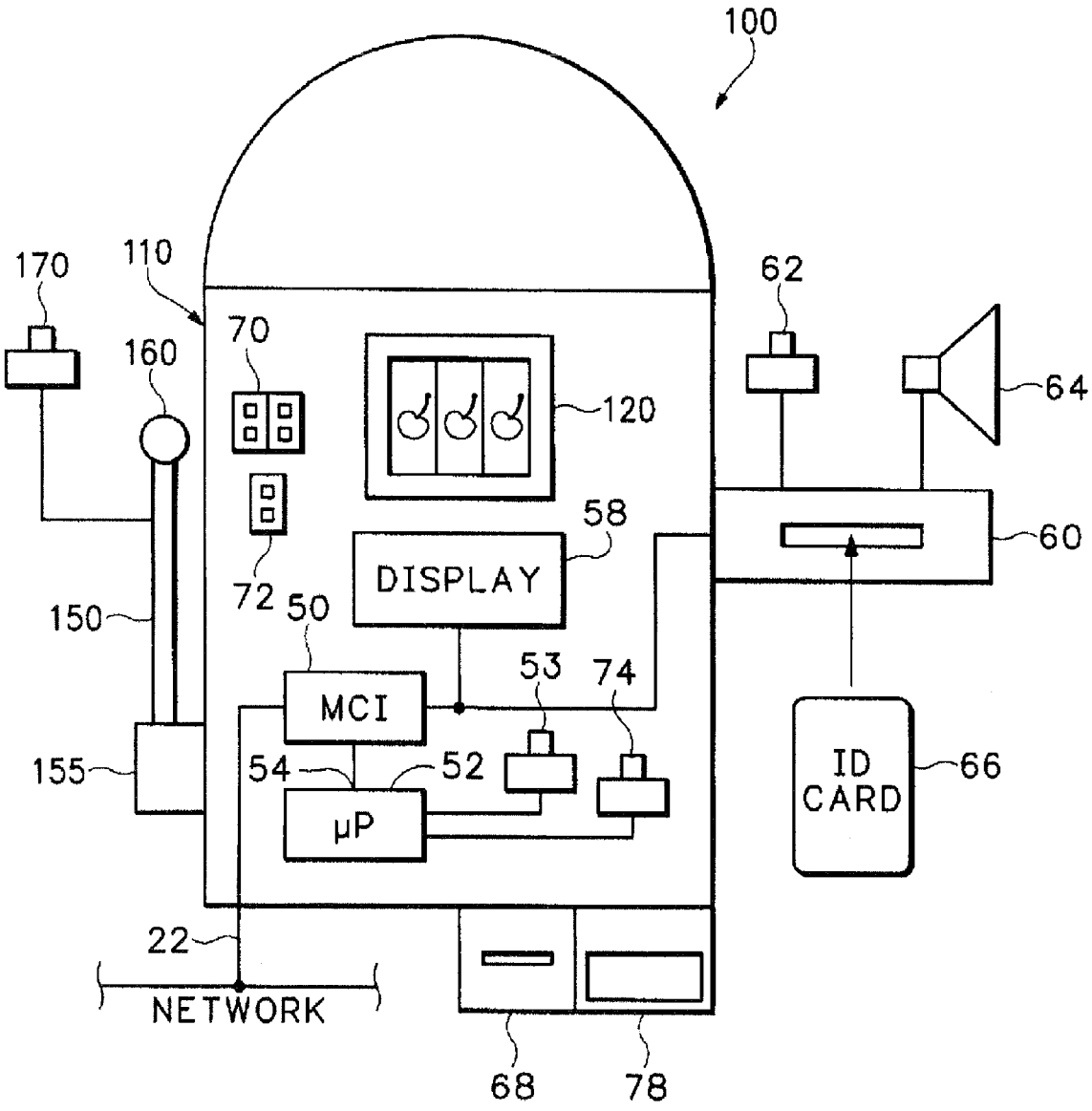
FIG. 1A is a schematic view of a gaming device according to an embodiment of the present invention.

To address the problems discussed above and other problems, embodiments of the present invention are directed to a gaming handle of a gaming device, where the gaming handle includes at least one peripheral player interaction mechanism. Some of these embodiments are described below in detail, and in addition, some specific details are shown for purposes of illustrating the inventive principles. However, numerous other arrangements are possible and may be devised in accordance with the inventive principles of this patent disclosure. Thus, while the present invention is described in conjunction with the specific embodiments illustrated in the drawings, it is not limited to these embodiments or drawings. Rather, it is intended to cover alternatives, modifications, and equivalents that come within the scope and spirit of the inventive principles set out in the appended claims. Further, well-known processes have not been described in detail in order to not obscure the present invention. Thus, the inventive principles are not limited to the specific details disclosed herein.

Figure 1B:
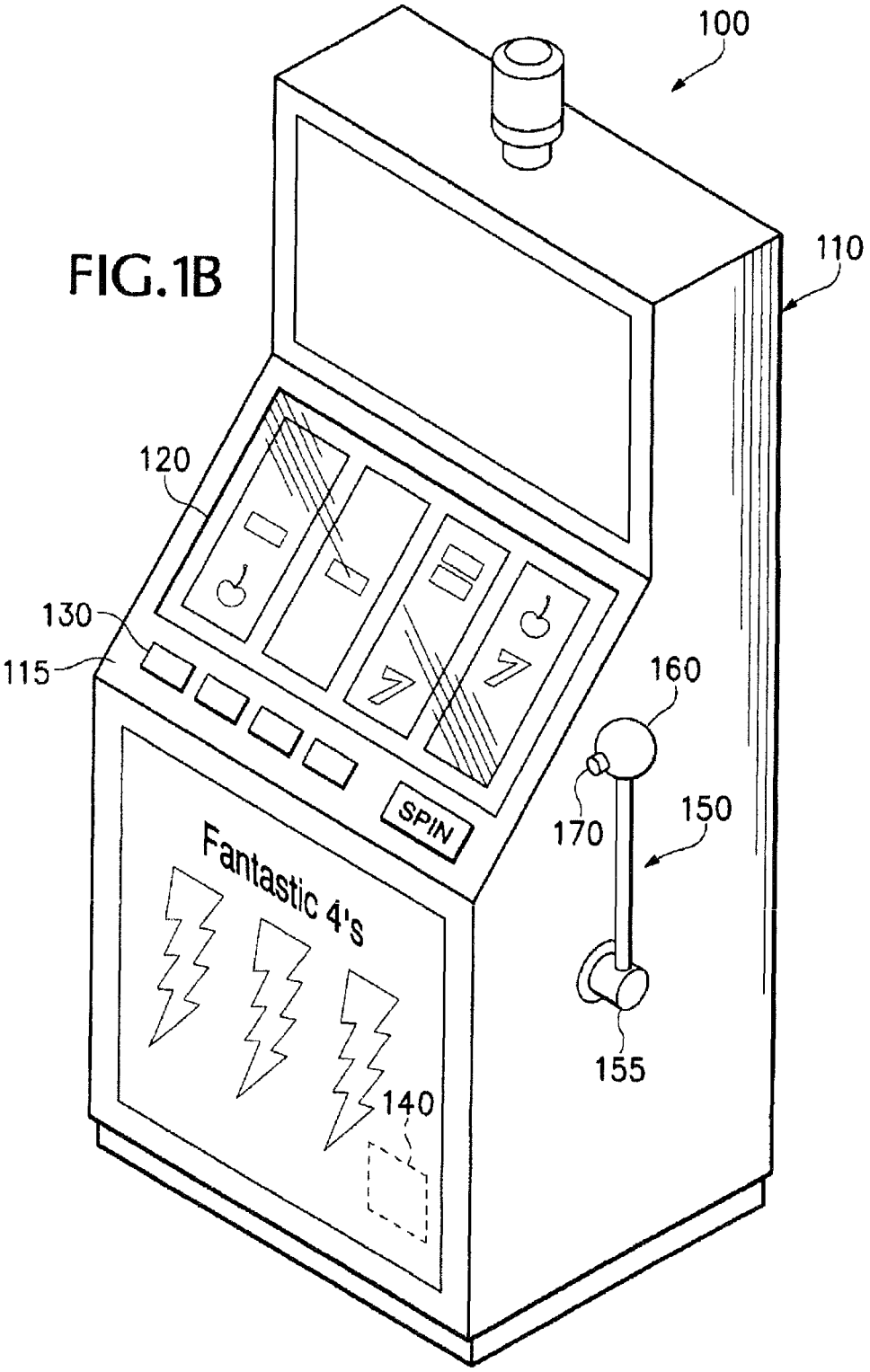
FIG. 1B is an isometric view of the gaming device illustrated in FIG. 1.

FIGS. 1A and 1B illustrate a gaming device according to an embodiment of the present invention. FIG. 1A is a schematic view of the gaming device and FIG. 1B is an isometric view of the gaming device.

Referring to FIGS. 1A and 1B, the gaming device 100 shown in this embodiment is an electro-mechanical slot machine. That is, the gaming device 100 is a spinning reel type slot machine, where the reels are driven by mechanical means, such as stepper motors (not shown), that are controlled by electronic circuitry housed in the gaming device 100. Although the embodiment shown in FIGS. 1A and 1B includes such a electro-mechanical slot machine, other embodiments of the present invention may include various non-spinning reel type gaming devices, such as video slot machines, computer based gaming machines, wireless gaming devices, multi-player gaming stations, modified personal electronic gaming devices, and the like.

Returning to the embodiment shown in FIGS. 1A and 1B, the gaming device 100 includes a gaming cabinet 110 that houses various components of the gaming device 100. The gaming cabinet 110 may include a display area 120 that displays the result of a gaming session and a player interface area 115 or panel that includes one or more buttons 130 for game play. The gaming device 100 also includes a gaming handle 150 that is coupled to the gaming cabinet 110 by way of a coupler 155. The gaming handle 150 may include a top portion 160 and a player interaction device 170. Additional details of the gaming handle 150 and the player interaction device 170 included with the gaming handle 150 are discussed in further detail below. However, basic features and operations of the gaming device 100 will first be discussed.

The gaming device 100 may be connected to a gaming server or other gaming devices (see FIG. 7 for example) through a gaming network 22 that connects to the gaming device 100 through a machine communication interface (MCI) 50 housed in the gaming cabinet 110. The MCI 50 may facilitate communication between the network 22 and processor 52, which controls the operation of the gaming device 100. This communication may occur via a serial port 54 on the processor to which the MCI 50 is connected.

Also included in the gaming device 100 is a display area 120 that may include three to five spinning reels. Note that while the schematic view (FIG. 1) generally represents the display area 120 as having three spinning reels, the isometric view of the gaming device 100 in FIG. 1B shows the gaming machine 100 having a display area 120 including four reels. Each reel includes a plurality of different symbols thereon. These reels may spin in response to a gaming session being initiated in response to, for example, a pull on a gaming handle 150 or actuation of a spin button 53 after a wager is made. One or all of the reels in display area 120 may include a special bonus initiator symbol which, when obtained on the gaming machine's payline, will cause the MCI 50 to initiate the secondary bonus game.

The MCI 50 may also include a random access memory (RAM), which can be used to store gaming information, such as storing total coin-in statistics about a present gaming session. The MCI may also facilitate communication between the network 22 and a vacuum florescent display (VFD) 58, a card reader 60, a player-actuated push button 62, and a speaker 64.

During typical play on a slot machine, like gaming device 100, a player plays by placing a wager and then initiating a gaming session by pulling the gaming handle 51 or depressing the spin button 53. The wager may be placed, for example, by inserting a bill into a bill acceptor 68. The gaming device 100 may also include a coin acceptor (not shown) that may also be used by the player to make a wager. A credit meter 70 is a numeric display that indicates the total number of credits available for the player to wager. The credits are in the base denomination of the machine. For example, in a nickel slot machine, when a five-dollar bill is inserted into bill acceptor 68, a credit of "100" appears on credit meter 70. To place a wager, the player can generally depress a coin-in button (one of the buttons on the player interface panel 115, such as 130), which transfers a credit from the credit meter 70 to a coin-in meter 72. Each time the button is depressed a single credit transfers to the coin-in meter up to a maximum bet that can be placed on a single play of the machine. In addition, a maximum-bet button 74 may be provided to immediately transfer the maximum number of credits that can be wagered on a single play from the credit meter 70 to the coin-in meter 72, and may further initiate the gaming session by spinning the reels. Otherwise when the coin-in meter 72 reflects the number of credits that the player intends to wager, the player can initiate the gaming session by pulling the gaming handle 150 or depressing the spin button 53.

The player may choose to have any jackpot won applied to credit meter 70. When the player wishes to cash out, the player depresses a cash-out button (another button on the player interface panel 115, such as 130), which causes the credits on meter 70 to be paid out to the player in the form of a ticket (which can later be cashed in or inserted into another gaming device) through ticket printer 78, or may be paid out in the form of returning coins to the player at a hopper (not shown). The machine consequently pays to the player the number of credits—in the base denomination of the machine—that appear on credit meter 70.

Card reader 60 may read a player-tracking device, such as a player tracking card 66 that is issued by the casino to individual players who choose to have such a card. Card reader 60 and player-tracking card 66 are known in the art, as are player-tracking systems. Briefly summarizing such a system, a player registers with the casino prior to commencing gaming. The casino issues a unique player-tracking card to the player and opens a corresponding player account that is stored on a server or host computer (see, for example, FIG. 7). The player account may include the player's name and mailing address and perhaps other information of interest to the casino in connection with marketing efforts. Prior to playing one of the gaming devices in the casino, the player inserts the player tracking card 66 into the player tracking reader 60 thus permitting the casino to track player activity, such as amounts wagered, credits won, and rate of play.

To induce the player to use the card, the casino may award each player points proportional to the money wagered by the player. Players consequently accrue points at a rate related to the amount wagered. The points may be displayed on display 58. In conventional player tracking systems, the player may take his or her card to a special desk in the casino where a casino employee scans the card to determine how many accrued points are in the player's account. The player may then redeem points for selected merchandise, meals in casino restaurants, or the like, which each have assigned point values.

As mentioned above, gaming handle 150 is coupled to the gaming cabinet 110 through coupler 155. The gaming handle 150 may be located on the right side of the gaming device 100 as with traditional gaming handles (side being determined by a side of a person facing the front of the gaming device). However, the gaming handle 150 may also be located on the left side of the gaming device or be located in the traditional player interaction portion 115 of the gaming cabinet (see FIG. 6, for example). Although it may be preferable to couple the gaming handle 150 to the right side of the gaming cabinet 110 because players are more familiar with this orientation, it may also be preferable to locate the gaming handle in a different portion of the gaming cabinet 110 so that the unique features of the gaming handle 150 stand out to the player as something different from conventional gaming handles. Additionally, some of the functionality of the gaming handles may determine the optimum location for them.

The coupler 155 that is used in part to attach the gaming handle 150 to the gaming cabinet 110 may include a mechanism that allows the game handle 150 to be manipulated toward the player for a predetermined distance to initiate a gaming session. That is, a player may pull the gaming handle 150 toward them to initiate a gaming session after a wager has been placed. The coupler 155 may also include a mechanism such as a spring to return the gaming handle 150 to its initial resting position after a player has pulled the gaming handle 150 and let go of the gaming handle 150. The coupler 155 may also include a detection mechanism for detecting when the gaming handle 150 has been pulled by the player. The coupler 155 will generally not detect slightly movements or pulls on the gaming handle; rather the coupler 155 will only trigger the initiation of a gaming session after the handle has been pulled past a certain point. This is in part to prevent accidental game initiations when only a partial wager has been made. Conventionally, the coupler 155 will not allow the gaming handle to be pulled when a wager has not yet been made, i.e., it locks the gaming handle 150 in its initial position to prevent non-wagering players from wearing out the manipulation mechanisms of the gaming handle 150.

The gaming handle 150 includes a peripheral player interaction mechanism 170 that allows a player to interact with the gaming device 100. In the embodiment shown in FIGS. 1A and 1B, the peripheral player interaction mechanism 170 is included in the top portion 160 of the gaming handle 150. More specifically, in this embodiment, the peripheral player interaction mechanism 170 is a button that a player may push with their thumb or finger. The peripheral player interaction button 170 may be located on the side of the top portion 160 of the gaming handle 150 so that it corresponds to the natural location of a player's thumb when the player grasps the top portion 160 of the gaming handle 150 in an over-hand manner. The peripheral player interaction button 170 may also be located near the top surface of the top portion 160 of the gaming handle 150 so that it corresponds to a player's thumb placement if the handle is grasp in a grip-like fashion, or so that it corresponds to a player's finger placement if the handle is grasp in an overhand manner.

The peripheral player interaction button 170 may include the functionality of one of the buttons that conventionally is located on the player interaction panel 115 of the gaming cabinet 110. As mentioned above, some of these button functionalities include the 'bet one' button for increasing a wager, a 'max bet' button for wagering the maximum allowed, a 'cash out' button for retrieving credits from the machine in the form of a ticket or coins, a 'spin' button for initiating a gaming session play, or a 'service' button for signaling a casino employee that assistance is needed. Additionally, the player interaction button 170 may have a specialized function associated with a particular game. For example, depressing the player interaction button 170 may initiate a bonus mechanism in a bonus game (such as spinning the wheel in a wheel based bonus game) or act as a trigger stop button in a phantom spin bonus game.

Although the discussion above with regard to the embodiments shown in FIGS. 1A and 1B describe the peripheral player interaction mechanism 170 as a button, other embodiments of the present invention may specify that the peripheral player interaction mechanism 170 be structured in different manners and have various other functionalities. Some of these embodiments are discussed below with reference to FIG. 2A through FIG. 6. However, even these embodiments do provide an exhaustive list of the possible configurations of the peripheral player interaction mechanism 170. Rather, the peripheral player interaction mechanism 170 included on the gaming handle 150 may take any form that allows a player to interact with the gaming device 100. As described in the embodiments below, this interactive structure may take the form of a simple button or switch, or may include more complex interactive structures such as touchscreen displays or docking stations for personal gaming modules.

Additionally, the player interaction mechanism 170 may include various player interaction functionalities associated with it. The specific functionality associated with the player interaction mechanism 170 may be selectable by a player playing the gaming device 100 or a casino operator. In the case where the functionality of the player interaction mechanism 170 is selectable by the casino operator, firmware settings may be used to in the gaming circuitry connected to the processor 52 to effectuate a selection of the function associated with the player interaction mechanism 170. In other embodiments, the functionality may be selected by manipulating a mechanical switch that is located inside the gaming cabinet 110 or coupled to the outside of the gaming cabinet 110. In the case where the functionality of the player interaction mechanism 170 is selectable by the player, a mechanical switch coupled to the gaming cabinet may be used to effectuate a selection, a menu setting on a secondary display screen may be used for the selection, or a player preference stored in a player tracking account may be downloaded over the network 22 to automatically make the selection. A default setting for the function associated with the player interaction mechanism 170 may also be preferable. The function associated with the player interaction mechanism 170 may return to the default setting after all the credits on gaming device 100 have been wagered, a player tracking card is removed from the gaming device 100, or the remaining credits are cashed out of the gaming device 100.

In conventional electro-mechanical slot machines, such as gaming device 100, the top portion 160 of a gaming handle 150 is usually a black spherical-shaped structure mounted on a cylindrical chrome-shaded handle body. Embodiments of the present invention may be structured to retain this conventional look, by retaining the chrome-shaded handle body and simply adding a button 170 to the black spherical-shaped top portion 160 of the gaming handle 150. The button 170 may be electrically connected to the processor 52 or the MCI 50 through signal wires that run down the interior of the gaming handle. However, in other embodiments, the signal generated by manipulating the button 170 may be transmitted wirelessly to a receiver 140 housed in the gaming cabinet 110.

It is also contemplated that existing gaming devices 100 with gaming handles 150 may be retrofitted with a new gaming handle 150 that includes a peripheral player interaction mechanism 170. This may be accomplished by simply replacing the top black ball of the existing gaming devices with a new top portion 160 of the gaming handle 150 with a player interaction mechanism 170 that wireless communicates to a receiver 140 enclosed in the gaming cabinet 110 and connected to the game processor 52. In such a configuration, minimal structural alteration is needed to the gaming cabinet 110, but a receiver 140 and additional firmware or software may have to be added inside of the gaming cabinet. Another method of retrofitting existing gaming devices 100 with a gaming handle 150 that includes a player interaction mechanism 170 is to replace the entire gaming handle 150 and coupler 155 of the gaming device. In this configuration, the player interaction mechanism may be hardwired to the circuitry inside the gaming cabinet and electrically connected to the gaming processor 52.

While this configuration may require a more extensive replacement, it may be advantageous over the wireless top portion configuration because it would not require an additional receiver 140 or power source.

Figure 2A:
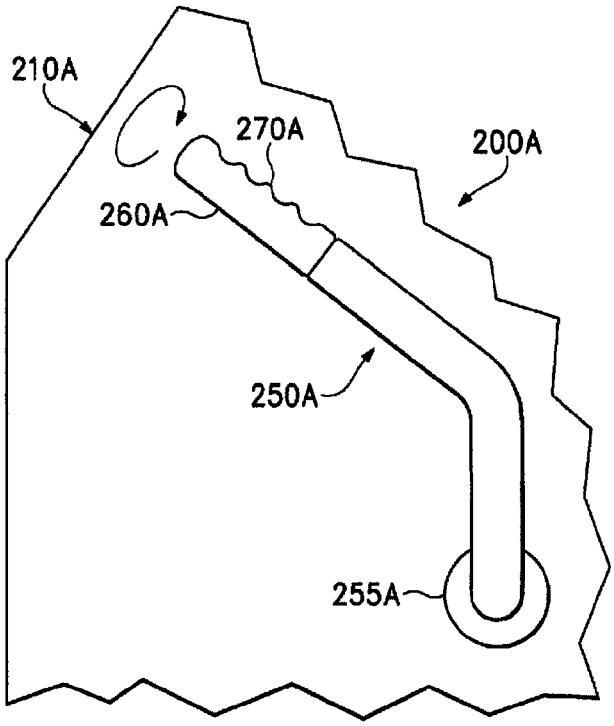
FIG. 2A is a side view of a gaming device according to another embodiment of the present invention.
Figure 2B:
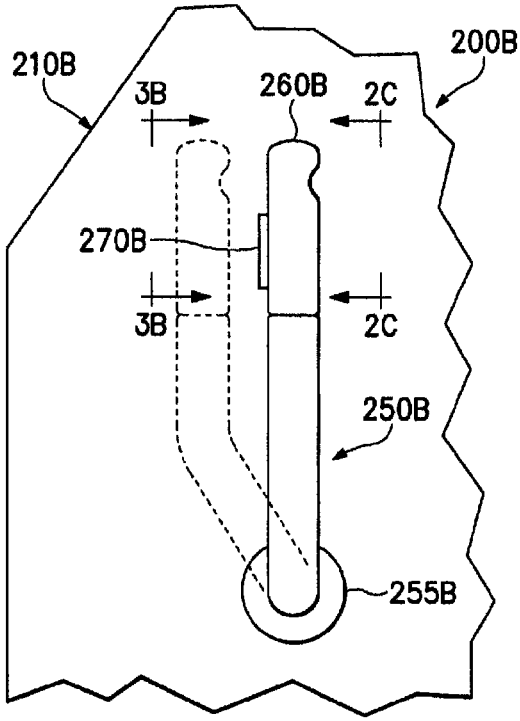
FIG. 2B is a side view of a gaming device according to yet another embodiment of the present invention.
Figure 2C:
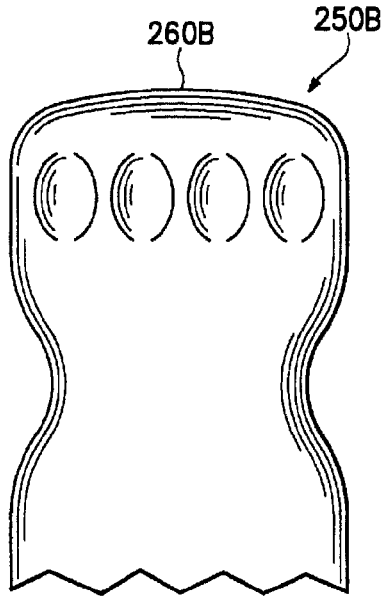
FIG. 2C is a view of the gaming handle illustrated in FIG. 2B taken along the line 2C.

FIGS. 2A-2C illustrate different gaming handle configurations of a gaming device according to embodiments of the present invention. FIG. 2A is a side view of a gaming device including a gaming handle according to an embodiment of the present invention. FIGS. 2B and 2C respectively illustrate a side and plan view of a gaming device including a gaming handle according to another embodiment of the present invention.

Referring to FIG. 2A, gaming device 200A includes a gaming cabinet 210A with a gaming handle 250A coupled to the gaming cabinet 210A with a coupler 255A. The gaming handle 250A extends in a substantially vertical direction from the coupler 255A and then angles toward the front of the gaming device 200A. This gaming handle orientation may make the gaming handle 250A easier to reach for players sitting further from the front of the gaming device 200A or players with shorter arm lengths. Further, this gaming handle orientation may encourage a player to notice and interact with the gaming handle 250A because of its unique style and accessibility. The coupler 255A may allow the gaming handle 250A to be manipulated in at least one direction. Additionally, the coupler 255A may include springs to return the gaming handle 255A to an initial position after it has been manipulated by a player.

The gaming handle 250A may also include a peripheral player interaction device 270A in the top portion 260A of the gaming handle 250A. The top portion 260A of the gaming handle 250A illustrated in FIG. 2A includes a rotatable grip section 270, where rotation of the grip section 270 allows the player to interact with the gaming device 200A. That is, the gaming handle 250A includes a grip section 270A that may be rotated clockwise or counter-clockwise by a player, where the rotation of the grip section 270A triggers a player interaction mechanism. For example, the rotation of the grip section 270A may increment the amount of a wager placed on a gaming session. Thus, in the above example, a player may twist the rotatable grip section 270A twice to bet two and then pull the gaming handle 250A towards them to initiate the gaming session in which they had wager two credits. The rotatable grip section 270A may further have an ergonomically shaped portion so that a player's hand will fit comfortably on the gaming handle 250A.

Referring to FIGS. 2B and 2C, the gaming device 200B includes a gaming cabinet 210B with a gaming handle 250B coupled to the gaming cabinet 210B with a coupler 255B. Unlike the gaming handle 250A illustrated in FIG. 2A, the gaming handle 250B illustrated in the embodiments shown in FIGS. 2B and 2C is broader and may be shorter in overall length. For a perspective view of this type of handle see FIG. 4. Although the gaming handle 250B is shown with a substantially vertical orientation in FIG. 2B, the gaming handle 250B may initially angle toward the front of the gaming device 200B before angling back to a substantially vertical position (represented by the dashed lines in FIG. 2B). Such an orientation may place the gaming handle 250B closer to the player for improved access to the gaming handle 250B by the player. Additionally, the gaming handle 250B may be adjustable between multiple positions, such that a player or casino operator may adjust the gaming handle between a plurality of initial positions.

The top portion 260B of the gaming handle 250B may include ergonomic depressions and protrusions to comfortably fit with a player's hand shape, as shown in FIG. 2C. More specifically, FIG. 2C illustrates the rear side of the handle; that is the side of the handle that faces the rear of the gaming cabinet 210B (taken along the line 2C in FIG. 2B). As FIG. 2C illustrates, the top portion 260B of the gaming handle 250B may further include slightly tapered sides and a rounded top surface. The broader layout of the gaming handle 250B may help facilitate space for peripheral player interaction mechanisms 270B that require more area, such as a player card reader (see FIG. 3B), a secondary display screen (see FIG. 3D), a docking station (see FIG. 3E), or the like. These peripheral player interaction mechanisms 270B are generally mounted on the front side of the gaming handle 250B (that is, the side facing the front of the gaming device 210B or the left side in FIG. 2B) to provide easier access for the player to the interaction mechanism 270B. Further, the substantially vertical orientation of the gaming handle 250B may help keep such peripheral player interaction mechanisms 270B visible and readily accessible to a player or casino operator. As with the gaming handle 250A illustrated in FIG. 2A, the gaming handle 250B illustrated in FIG. 2B may be manipulated in a variety of directions by use of the coupler 255B.

Figure 3A:
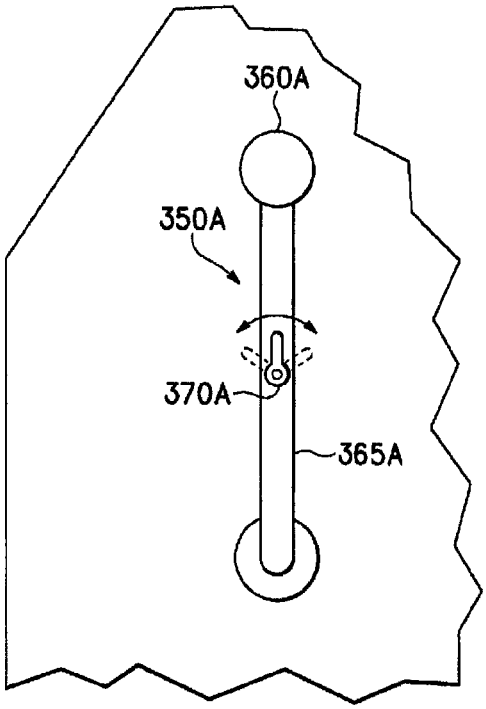
FIG. 3A illustrates a detailed view of a gaming handle according to another embodiment of the present invention.
Figure 3B:
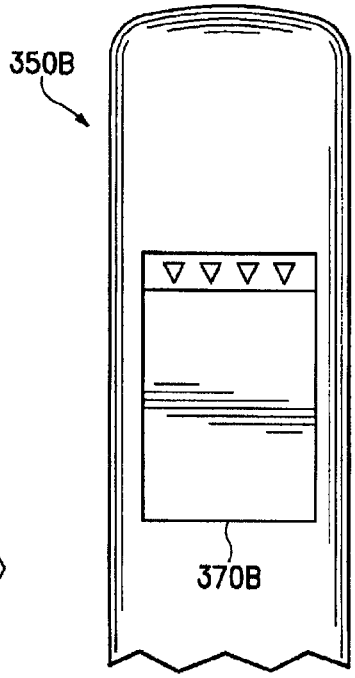
FIG. 3B is a detailed view of the gaming handle illustrated in FIG. 2B taken along the line 2B.
Figure 3C:
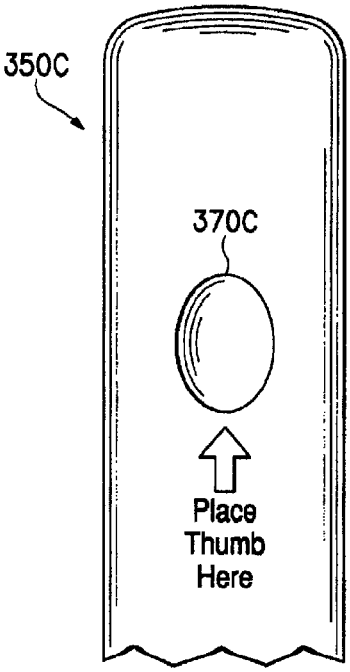
FIGS. 3C-3E show alternative embodiments of the gaming handle illustrated in FIG. 3B.
Figure 3D:
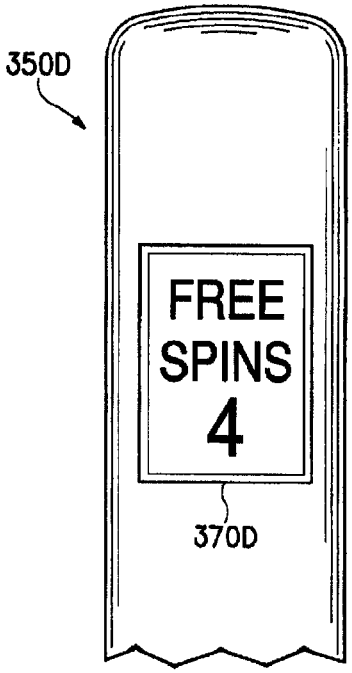
Figure 3E:
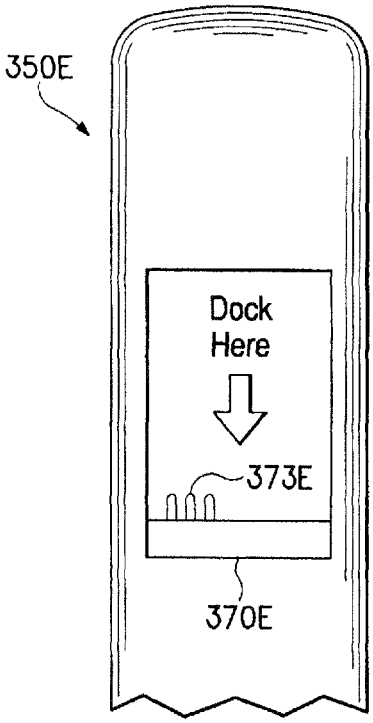

FIGS. 3A-3E illustrate detailed views of gaming handles according to various embodiments of the present invention. FIG. 3A illustrates a detailed view of a gaming handle according to another embodiment of the present invention. FIG. 3B is a detailed view of the gaming handle illustrated in FIG. 2B taken along the line 2B. FIGS. 3C-3E show alternative embodiments of the gaming handle illustrated in FIG. 3B.

Referring to FIG. 3A, the gaming handle 350A includes a top portion 360A and a body portion 365A. The body portion 365A of the gaming handle 350A includes a toggle switch 370A with which a player may interact. In particular, the player may set the toggle switch 370A to one of three positions represented by the dashed lines. Toggles switches 370A in various other embodiments may only include two positions or may include four or more positions. Further, the toggle switch 370A may be in the form of a button with multiple positional settings, an electronic switch with multiple states, or a mechanical toggle switch with multiple physical positions. The toggle switch 370A may allow the player to select options for how the game machine plays, such as the speed of the reel spins or the speed of the credit roll up, or may allow the player to vary the function of a gaming handle 350A pull or function of one of the other player interaction devices (such as those shown on the player interaction panel 115 in FIG. 1B). For example, the toggle switch 370A may allow a player to chose to place a max bet and spin the reels with each press of a "SPIN" button in one position, place the minimum bet and spin the reels with each press of the "SPIN" button a second position, or only allow the "SPIN" button to spin the reels after the player has pressed the "BET ONE" button at least one time in a third position.

In other embodiments, the toggle switch 370A may be located on the top portion 360A of the gaming handle 350A. Also, the toggle switch 370A may have its functionality customizable by a casino operator or a player. A player may also have his or her preferences stored in their player tracking account so that when they insert their player tracking card into a gaming device that includes a gaming handle 350A with a toggle switch 370A the functionality of the toggle switch adapts to the set preferences stored in the identified player's player tracking account.

Referring to FIG. 3B, the gaming handle 350B includes a player tracking device reader 370B. The player tracking device reader 370B may read a variety of player tracking methods that may be implemented by a casino. For example, a shown in FIG. 3B, the player tracking device reader 370B may accept and hold a player tracking card and include a magnetic strip reader or electronic circuit decoder to read the identifying information on the player tracking card. However, in other embodiments, the player tracking device reader 370B may include only an electronic pad to read the chip in a player's driver license or credit card when they place the card in close proximity to the player tracking device reader 370B.

Referring to FIG. 3C, the gaming handle 350C includes a biometric reader 370C. The biometric reader 370C may be used for player identifying and tracking purposes in a similar fashion as the player tracking reader 370B of FIG. 3B. The biometric reader 370C illustrated in FIG. 3C reads thumbprints of players for player identification purposes. However, any type of biometric reader 370C may be included in the gaming handle 350C.

Referring to FIG. 3D, the gaming handle 350D includes a display screen 370D. The display screen 370D is preferably a secondary display screen on the gaming device. The display screen 370D may be a VFD screen, an LCD screen, or the like. The display screen 370D may interact with a player by displaying information regarding a gaming session, such as total credits, credits bet, win amount, spins remaining on a "free spin" bonus, etc. The display screen 370B may also display a secondary bonus game. In some embodiments, the gaming handle 350D may include other player interaction devices, such as buttons or touch pads, so that the player can further interact with a secondary bonus displayed on the display screen 370D. Display screen 370D may also be a touchscreen where the player can interact directly with choices displayed on the display screen 370D.

Referring to FIG. 3E, the gaming handle 350E includes a docking station 370E. The docking station 370E may allow for the connection and docking of a personal gaming module (not shown). Personal gaming modules may include casino specific devices that store player information such as player identity and gaming history, or may include universal compatible devices such as cell phones loaded with specific software. Although the docking station 370E is shown as including connection pins 373E to connect to a personal gaming module, other embodiments may include infrared (IR) ports, wireless transmitters/receivers, or other similar devices that allow for the exchange of data between a personal gaming module and the gaming device 100 shown in FIG. 1. In addition to allowing the transfer of data, the docking station 370E may provide power to a personal gaming module so as to recharge its batteries. The docking station 370E may also be structured to hold the personal gaming module through, for example, retaining clips or a friction fit with the connection pins. This holding structure may further be arranged such that the personal gaming module is secure in the docking station 370E when the gaming handle 350E is manipulated.

Figure 4:
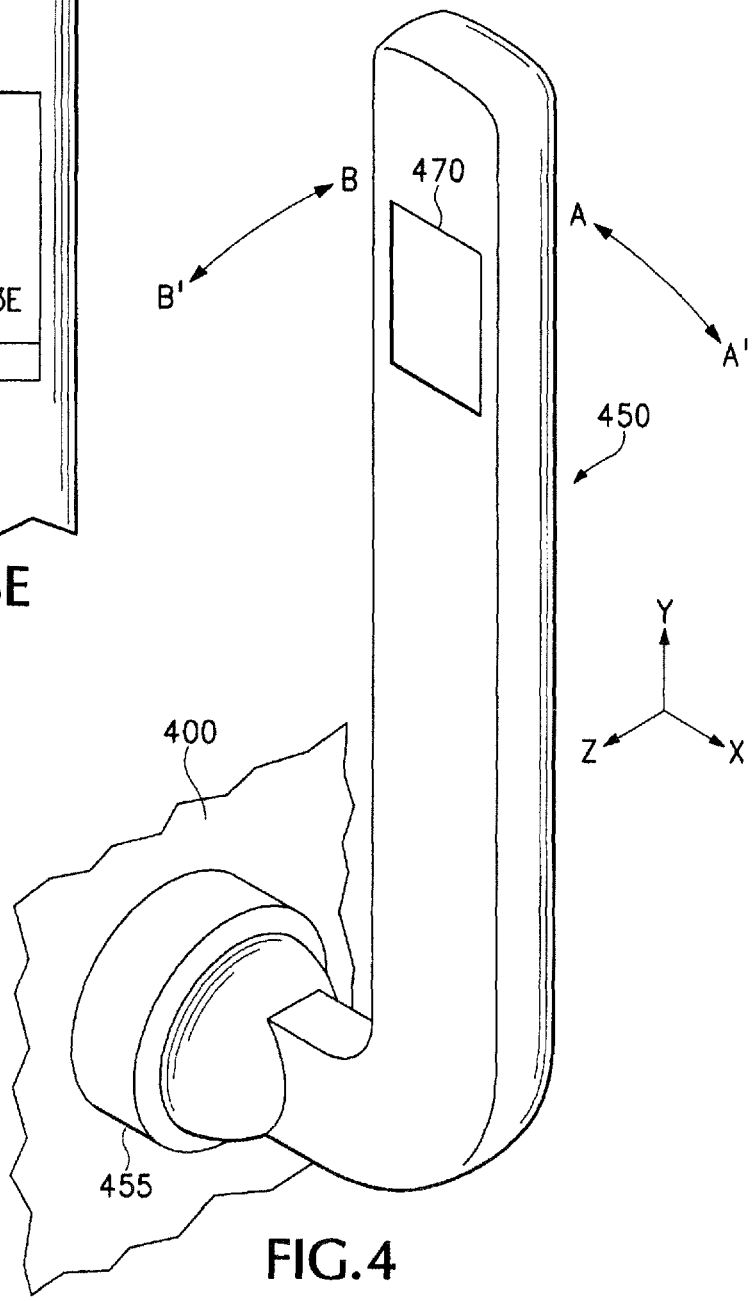
FIG. 4 is an isometric view of a gaming device according to another embodiment of the present invention.

FIG. 4 is an isometric view of a gaming device according to another embodiment of the present invention. Referring to FIG. 4, a gaming handle 450 including a peripheral player interaction device 470 is coupled to the gaming device 400 through a coupler 455 that allows the gaming handle 450 to be manipulated in multiple directions. For example, in the embodiment illustrated in FIG. 4, the coupler 455 allows for the gaming handle 450 to be manipulated toward a player along directional arc B-B' as well as allowing the gaming handle 450 to be manipulated away from the gaming device along directional arc A-A'. Certain functionality may further be associated with each of the movements of the gaming handle 450. For example, moving the gaming handle 450 along arc B-B' may initiate a gaming session, while moving the gaming handle 450 along arc A-A' may increment a wager placed.

In addition, if the peripheral player interaction device 470 is a toggle switch (as shown in FIG. 3A), each position of the toggle switch 470 may determine the functionality of one of the directions of movement of the gaming handle 450. For example, the movement along directional arc A-A' may be determined by the position of toggle switch 470 such that if the toggle switch 470 was placed at a first position, manipulation of the gaming handle 450 along A-A' may increment a wager amount while manipulation of the gaming handle 450 along A-A' may "cash out" a player when the toggle switch is in a second position.

Although the coupler 455 shown in FIG. 4 allows for two different directions of movement, the coupler 455 may be structured to allow for additional directions of movement. For example, in some embodiments, coupler 455 may include a universal joint that allows the gaming handle 450 to be manipulated in substantially all directions. The coupler 455 may further include springs or be otherwise biased so that it remains in a neutral position when it is not being manipulated by a player and returns to that natural position after a player has manipulated it in a direction and has let go of the gaming handle 450.

Figure 5:
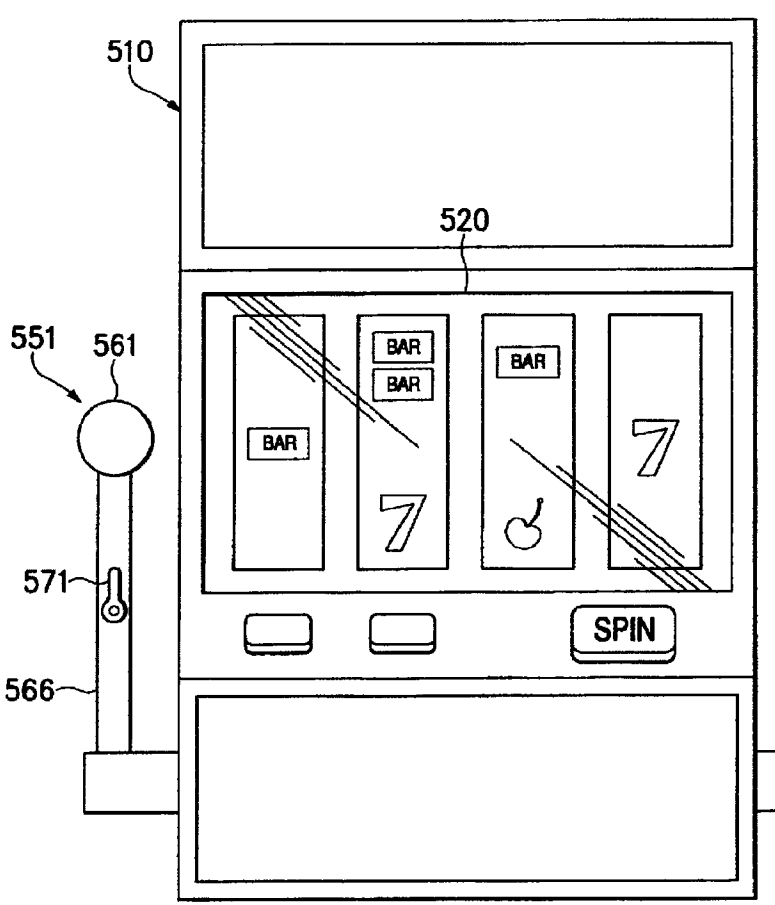
FIG. 5 is a plan view of a gaming device according to yet another embodiment of the present invention.

FIG. 5 is a plan view of a gaming device according to yet another embodiment of the present invention. Referring to FIG. 5, gaming device 500 includes a gaming cabinet having display area 520. Respectively coupled to either side of the gaming cabinet 510 are a first gaming handle 550 and a second gaming handle 551. Although the embodiment shown in FIG. 5 illustrates only a first and second gaming handle 550 and 551, additional gaming handles may be attached to the gaming device 500. The first gaming handle 550 includes a top portion 560 that has a first peripheral player interaction device 570 and a body portion 565. The first player interaction device 570 is shown as a button in the embodiment illustrated in FIG. 5; however, any type of player interaction device may implemented either on the top portion 560 of the gaming handle 550 or on the body portion 565 of the gaming handle 550. The second gaming handle 551 includes a body portion 566 that has a second peripheral player interaction device 571 and a top portion 561. The second player interaction device 571 is shown as a toggle switch in the embodiment illustrated in FIG. 5; however, as with the first peripheral player interaction device 570, the second peripheral player interaction device 571 may include any type of player interaction device and may be implemented anywhere along the second gaming handle 551.

Figure 6:
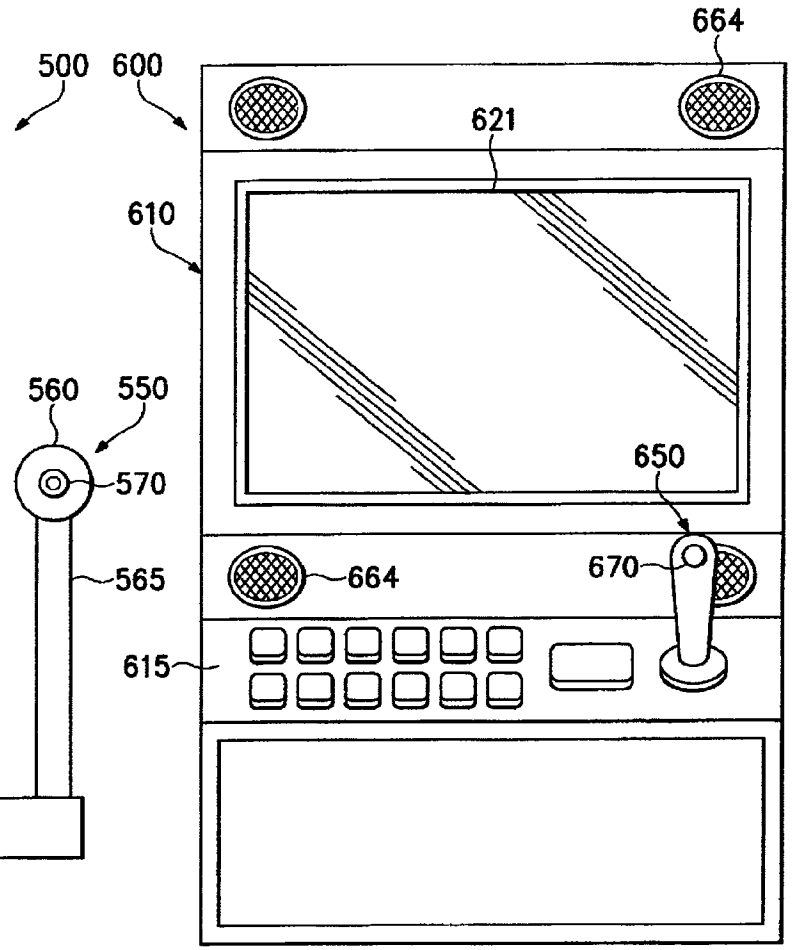
FIG. 6 is a plan view of a gaming device according to another embodiment of the present invention.

FIG. 6 is a plan view of a gaming device according to another embodiment of the present invention. Referring to FIG. 6, gaming device 600 includes a gaming cabinet 610 that houses a video gaming display monitor 621 and speakers 664. The gaming device 600 also includes a gaming handle 670 that is coupled to the gaming cabinet 610 in the traditional player interface portion 615 of the gaming cabinet 610. The gaming handle 650 further includes a button 670 for player interaction. The gaming handle 650 may be structured to be manipulated in a variety of directions like a joystick. This joystick style of gaming handle 650 may enable a player to move a cursor on the video display screen 621 and use the button 670 to make an item selection at which the cursor is indicating. This style of gaming handle 650 may be advantageous, for example, in second screen bonuses where a plurality of items may be selected by a player. Additionally, the gaming handle 650 may be easier to use than a touchscreen for players with limited mobility. The joystick style gaming handle 650 may also be formed such that it ergonomically fits a player's hand. This may include placing the player interaction button 670 in a 'trigger' format under a player's index finger or placing the player interaction button 670 on the top surface of the gaming handle 650 so that a player's thumb could easily reach the button.

Figure 7:
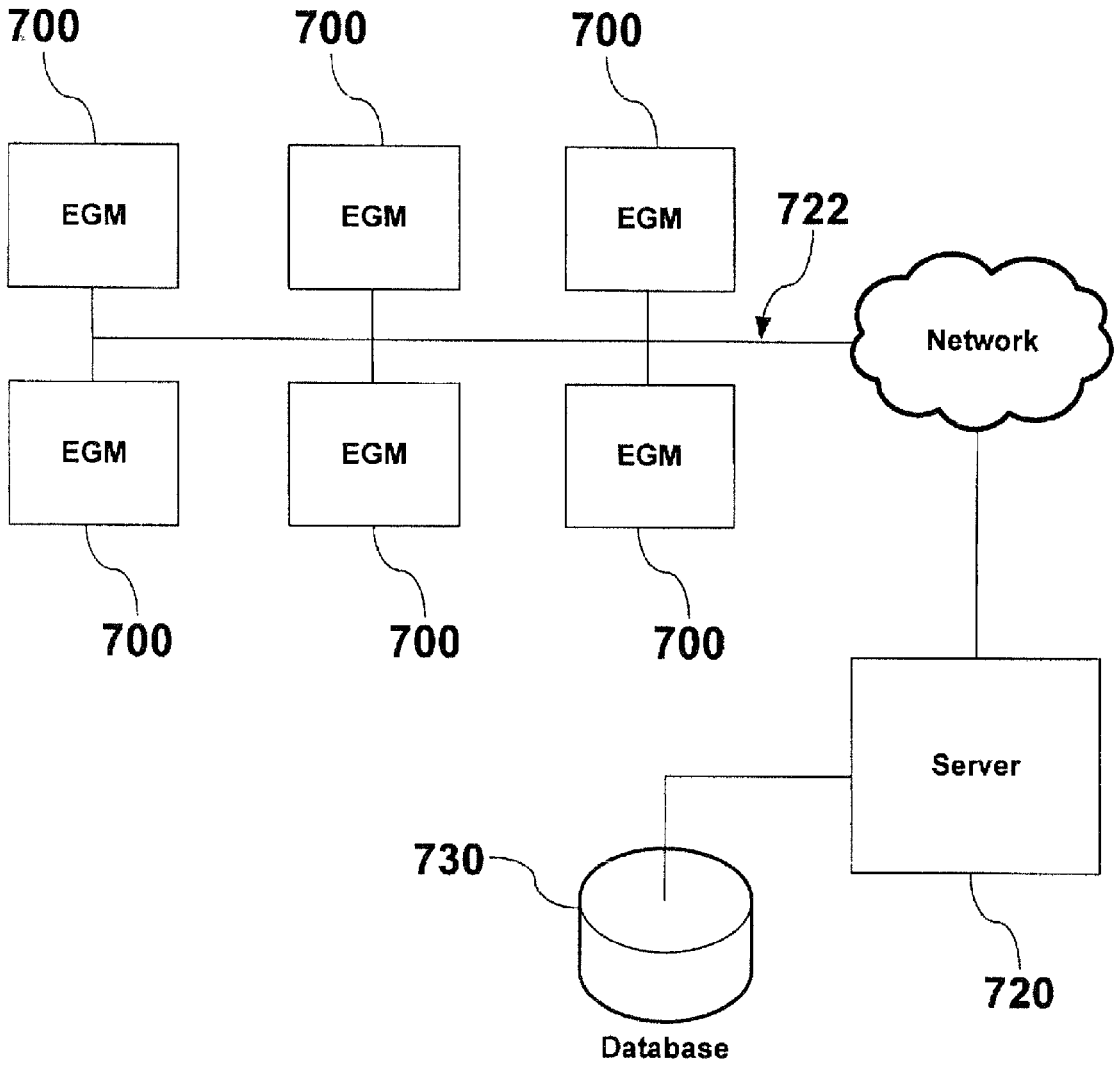
FIG. 7 is a block diagram of networked gaming devices according to an embodiment of the present invention.

FIG. 7 illustrates a block diagram of networked gaming devices according to an embodiment of the present invention. Referring to FIG. 7, multiple electronic gaming devices or machines (EGM) 700 may be connected together and connected to a remote server 720 via a network 722. Additionally, the gaming server 720 may be connected to one or more gaming databases 730. These gaming network 722 connections may allow multiple gaming devices 700 to remain in contact during particular gaming modes such as tournament play or remote head to head play. Although some of the gaming devices 700 connected on the gaming network 722 may resemble the gaming devices 100 shown in FIGS. 1A-1B, other connected gaming devices 700 may include traditional slot machines, smart tables, wireless handheld gaming machines, cell phones, etc. Therefore, while some of the gaming devices 700 connected to the gaming network 722 may have gaming handles with at least one peripheral player interaction mechanism, other gaming devices 700 connected to the same gaming network 722 may have conventional handles or no handles at all.

Further, although in some embodiments each gaming devices 500 may have individual game controllers so that game play is independently controlled by the processor housed in the gaming cabinet, in other embodiments each gaming device 500 may be a gaming terminal connected to a central server based game controller for operation of server based games, such as BINGO or keno.

In some embodiments, the network 722, server 720, and database 730 may be dedicated to communications regarding specific game or tournament play. However, in other embodiments, the network 722, server 720, and database 730 may be part of another existing system such as a player tracking network, server, and database. Additionally, a separate database 730 or server 720 may be connected to a common network 722 that can transmit both game/tournament data and player tracking data.

Having described and illustrated the principles of the invention in embodiments thereof, it should be apparent that the invention can be modified in arrangement and detail without departing from such principles.

We claim:

1. A gaming device operable by a player, the gaming device comprising:

a gaming cabinet comprising a front surface and a side surface oriented substantially perpendicular to the front surface;

a first visual display coupled to the front surface and configured to communicate a result of a gaming session to the player;

gaming circuitry housed inside the gaming cabinet, the gaming circuitry arranged to operate the gaming session;

a first interaction mechanism arranged on the gaming cabinet, the first interaction mechanism structured to allow the player to interact with the gaming device; and a gaming handle coupled to the side surface of the gaming cabinet via a coupler, wherein the gaming handle is operable by the player to initiate a gaming session and comprises a second interaction mechanism structured to allow the player to interact with the gaming device, the second interaction mechanism including a second visual display.

2. The gaming device of claim 1, where the second interaction mechanism displays a secondary game.

3. The gaming device of claim 1, where the second interaction mechanism displays information regarding a primary gaming session.

4. The gaming device of claim 3, where the gaming handle further includes an other player interaction device.

5. A gaming device operable by a player, the gaming device comprising:

a gaming cabinet comprising a front surface and a side surface oriented substantially perpendicular to the front surface;

a visual display coupled to the front surface and configured to communicate a result of a gaming session to the player;

gaming circuitry housed inside the gaming cabinet, the gaming circuitry arranged to operate the gaming session;

a first interaction mechanism arranged on the gaming cabinet, the first interaction mechanism structured to allow the player to interact with the gaming device; and a gaming handle coupled to the side surface of the gaming cabinet via a coupler, wherein the gaming handle is operable by the player to initiate a gaming session and comprises a second interaction mechanism structured to allow the player to interact with the gaming device, where the second interaction mechanism is a docking station structured to receive a personal player gaming module.

6. The gaming device of claim 1, where the visual display of the gaming cabinet includes at least three mechanical spinning reels.

7. A gaming device operable by a player, the gaming device comprising:

a gaming cabinet comprising a front surface and a side surface oriented substantially perpendicular to the front surface;

a visual display coupled to the front surface and configured to communicate a result of a gaming session to the player;

gaming circuitry housed inside the gaming cabinet, the gaming circuitry arranged to operate the gaming session;

a first interaction mechanism arranged on the gaming cabinet, the first interaction mechanism structured to allow the player to interact with the gaming device; and a gaming handle coupled to the side surface of the gaming cabinet via a coupler, wherein the gaming handle is operable by the player to initiate a gaming session and comprises a second interaction mechanism structured to allow the player to interact with the gaming device, where the second interaction mechanism includes a wireless receiver.

8. A gaming system comprising:

a gaming server; and a gaming device connected to the gaming server through a gaming network, the gaming device comprising a gaming cabinet, a button coupled to a front surface of the gaming cabinet, and a gaming handle connected to a side surface of the gaming cabinet via a coupler, the side surface oriented substantially perpendicular to the front surface, where the gaming handle comprises at least one user interface device structured to facilitate interaction between a player and the gaming device to control an operation of the gaming device associated with the button, and wherein the coupler is configured to lock the gaming handle in an initial position prior to a start of a gaming session on the gaming device, where the user interface device comprises at least a portion of a player tracking device comprising a player tracking card reader.

9. The gaming system of claim 8, where the user interface device comprise a biometric scanner.

* * * * *